US010758054B2

(12) United States Patent
Wang

(10) Patent No.: US 10,758,054 B2
(45) Date of Patent: Sep. 1, 2020

(54) DOUBLE FOLDING CHAIR

(71) Applicant: Michael Wang, San Francisco, CA (US)

(72) Inventor: Michael Wang, San Francisco, CA (US)

( * ) Notice: Subject to any disclaimer, the term of this patent is extended or adjusted under 35 U.S.C. 154(b) by 10 days.

(21) Appl. No.: 16/357,750

(22) Filed: Mar. 19, 2019

(65) Prior Publication Data

US 2020/0154897 A1 May 21, 2020

Related U.S. Application Data

(63) Continuation-in-part of application No. 29/670,749, filed on Nov. 19, 2018.

(51) Int. Cl.

| | |
|---|---|
| ***A47C 11/00*** | (2006.01) |
| ***A47C 7/62*** | (2006.01) |
| ***A47C 4/28*** | (2006.01) |

(52) U.S. Cl.

CPC ..... *A47C 11/005* (2013.01); *A47C 4/286* (2013.01); *A47C 7/624* (2018.08)

(58) Field of Classification Search

CPC ..... A47C 11/005; A47C 7/624; A47C 4/286; A47C 4/28; A47C 1/124

USPC ..... 297/42, 45, 232, 233

See application file for complete search history.

(56) References Cited

U.S. PATENT DOCUMENTS

| | | | | |
|---|---|---|---|---|
| 5,570,928 | A | 11/1996 | Staunton | |
| 5,951,103 | A | 9/1999 | Barnhill | |
| 5,984,406 | A | 11/1999 | Lee | |
| 6,231,119 | B1 | 5/2001 | Zheng | |
| 6,454,348 | B1 * | 9/2002 | Wu | A47C 4/286 297/16.2 |
| 7,716,797 | B2 * | 5/2010 | Kismarton | B64D 11/06 244/122 R |
| 10,334,954 | B1 * | 7/2019 | Horowitz | A47C 11/005 |
| 2004/0207237 | A1 | 10/2004 | Chen | |
| 2004/0207240 | A1 | 10/2004 | Tondino | |
| 2008/0100107 | A1 | 5/2008 | Paslawski | |
| 2011/0049942 | A1 * | 3/2011 | Gorinas | A47C 4/286 297/118 |
| 2019/0038029 | A1 * | 2/2019 | Zhu | A47C 4/283 |
| 2019/0357683 | A1 * | 11/2019 | Brensinger | A47C 4/286 |
| 2020/0154891 | A1 * | 5/2020 | Frankel | A47C 5/10 |

* cited by examiner

*Primary Examiner* — Mark R Wendell
(74) *Attorney, Agent, or Firm* — Clement Cheng

(57) ABSTRACT

A double folding chair has a left chair with a left chair front inside foot and a left chair front inside joint. A left chair front cross brace supports the a left chair front inside joint above the left chair front inside foot. The left chair front cross brace unfolds to an expanded configuration. A right chair has a right chair front inside foot and a right chair front inside joint. A right chair front cross brace supports the right chair front inside joint above the right chair front inside foot. The right chair front cross brace unfolds to an expanded configuration. An upper hinge connects the right chair front inside joint to the left chair front inside joint. A lower hinge connects the right chair front inside foot to the left chair front inside foot. A middle mesh panel connects the left chair to the right chair.

14 Claims, 9 Drawing Sheets

DOUBLE FOLDING CHAIR

The present invention claims priority from U.S. design patent application 29/670,749 filed Nov. 19, 2018 by same inventor Michael Wang entitled Double Camping Chair.

FIELD OF THE INVENTION

The present invention in the field of camping chairs.

DISCUSSION OF RELATED ART

A variety of different double folding chairs are found in the prior art.

For example, in United States patent publication number U.S. Pat. No. 5,570,928A, entitled Joined Concertina Chairs by inventor Bryan F. Staunton, published Nov. 5, 1996, the abstract discloses, "A multiple folding chair arrangement particularly concerned with 2, 3, 4, 5 and 6 chair multiples and comprising three or more rigid vertical support frames defining the sides of two or more chairs and having front and rear edges, two pairs of diagonally crossed members located, respectively, between the front and rear edge regions of each frame, each one of the pair of members being pivotally connected adjacent a lower end to a separate one of an adjacent frame and being pivotally joined to the other member at or near its midpoint, the upper ends of said two pairs of members defining a plane for a seat when the chair arrangement is in an erected seating configuration, and a brace pivotally connected adjacent to the upper ends of each member and pivotally connected to the adjacent support frame, the arrangement including hand grips associated with the upper end of one or more of each pair of members located at the rear of the chairs to enable the chairs to be folded whereby the frames are brought together into close proximity when the hand grips are gripped and raised.", the disclosure of which is incorporated herein by reference.

For example, in United States patent publication number U.S. Pat. No. 5,951,103A, entitled Foldable Combination Chairs and Table by inventor Claude Barnhill, published Sep. 14, 1999 the abstract discloses, "A portable collapsible chair structure includes two chaise lounges with a table structure held therebetween. Each chaise lounge has a collapsible canopy, and can be folded up into a compact package. Each of the chaise lounges includes two clamping structures. One clamping structure connects each chaise lounge to opposite sides of the table structure and the outside clamping structure on each chaise lounge is arranged to be connected to that on the other chaise lounge. For a folding operation, each chaise lounge is folded into a compact package, then each is folded over the table and held by the outer clamping structures. This folding function is facilitated by the nature of the clamping structures which include variable extensions.", the disclosure of which is incorporated herein by reference.

For example, in United States patent publication number US20080100107A1, entitled Folding Chair by inventor Howard Lee, published Nov. 16, 1999, the abstract discloses, "A folding chair having: a frame consisting of a pair of front crossed legs; a pair of back crossed legs; and two pairs of side crossed legs, each pair of crossed legs pivotally connected together where they cross. The lower ends of the front legs and the lower, front ends of the side legs are pivotally connected to first and second lower, front pads. The lower ends of the back legs and the lower, back ends of the side legs are pivotally connected to first and second lower, back pads. The upper ends of the back legs and the upper, back ends of the side legs are pivotally connected to first and second upper, back pads. The upper ends of the front legs and the upper, front ends of the side legs are pivotally connected to first and second upper, front pads. The upper ends of the front legs slidably pass through the first and second upper front pads, the upper ends bent to form hand rests above the upper front pads. The upper, front, ends of the side legs are pivotally connected to the upper front pads. Flexible seat means are connected to the frame with the corners at the four upper pads.", the disclosure of which is incorporated herein by reference.

For example, in United States patent publication number U.S. Pat. No. 6,231,119B1, entitled Foldable Dual-Chair by inventor Edward Zheng, published May 15, 2001, the abstract discloses, "A foldable dual-chair includes a pair of seat frames and a pair of back frame constructed to support a pair of fabric seats thereon respectively wherein a connecting frame is foldably supported between the two seat frames. The connecting frame includes a pair connecting leg posts each having an outer tube frame and an inner tube frame upwardly extended therefrom in a vertical movable manner. So, the connecting leg posts are capably of slidably adjusting their height in such a manner the foldable dual-chair is capable of folding up into a compact unit for easy storage and carriage.", the disclosure of which is incorporated herein by reference.

For example, in United States patent publication number US20040207240A1, entitled Collapsible Wheeled Dual-Chair by inventor David Tondino, published Oct. 21, 2004, the abstract discloses, "A collapsible dual-chair with trolley has a frame configuration which includes a plurality of tubular legs pivotally connected by pins and joined together by pivotal joint members. The frame configuration is collapsible and forms a dual-seat support when fully opened. A rigid base having wheels is mounted to a joint member and is attached to the frame configuration at a low end thereof such that the frame configuration can be converted into a trolley mode to transport especially when collapsed.", the disclosure of which is incorporated herein by reference.

For example, in United States patent publication number U.S. Pat. No. 5,984,406A, entitled Folding Chair Having Integrated Audio Port by inventor Ray N. Paslawski, published May 1, 2008, the abstract discloses, "A foldable outdoor chair for supporting at least one person. The chair comprises a framework for supporting the person. The framework, in turn, comprises at least two vertical posts having a plurality of crossbraces attached thereto such that the crossbraces and posts are moveable to convert the chair from a first unfolded position wherein the chair is adapted for seating and a second folded position wherein the chair is adapted for transportation. A flexible fabric is supported from the frame work. The fabric is adapted to provide both a seating surface and a seat back and defines at least one cutout in the seat back the cutout comprising a turned and bound periphery. When the chair is in the transportation mode, the seating surface and seat back are folded. A speaker is attached through the cutout and over the turned and bound periphery. An audio port comprising a plate is attached to one of a flexible, fabric arm rest, the seating surface of the chair and the seat back of the chair. The audio port is placed in a position whereby the person seated in the chair can access the audio port without turning in the chair and without rising from a seated position. A flexible baglike receptacle is attached to one of the flexible fabric arm rest and the flexible fabric seating surface. The receptacle is physically adapted to hold its contents inwardly from an outer periphery of the chair when the chair is in the folded position to protect the contents of the receptacle from damage.", the disclosure of which is incorporated herein by reference.

For example, in United States patent publication number US2004/0207237A1, entitled Combination of One Table and Two Chairs for Two Persons by inventor Libin Chen, published Oct. 21, 2014, the abstract discloses, "A combination of one table and two chairs for two persons includes two folding chairs and one folding table. Each of the folding chairs include arm tubes, front crossed tubes, back-rest tubes, Seating frame tubes, rear crossed tubes, and a chair surface fabric. The folding table includes front vertical tubes, front crossed tubes, rear Vertical tubes, rear crossed tubes, and a table surface fabric. The arm tubes are connected cross-wise to the front crossed tubes, and the crossed connection point is provided with a reinforced block. The Seating frame tubes are connected cross-wise to the back-rest tubes, and the arm tubes are connected to the front ends of the Seating frame tubes via U-shaped hinging elements. The upper portions of the rear crossed tubes are connected to the back-rest tubes, and the lower portions thereof are connected to the Seating frame tubes.", the disclosure of which is incorporated herein by reference.

SUMMARY OF THE INVENTION

A double folding chair has a left chair with a left chair front inside foot and a left chair front inside joint. A left chair front cross brace supports the a left chair front inside joint above the left chair front inside foot. The left chair front cross brace unfolds to an expanded configuration. A right chair has a right chair front inside foot and a right chair front inside joint. A right chair front cross brace supports the right chair front inside joint above the right chair front inside foot. The right chair front cross brace unfolds to an expanded configuration. An upper hinge connects the right chair front inside joint to the left chair front inside joint. A lower hinge connects the right chair front inside foot to the left chair front inside foot. A middle mesh panel connects the left chair to the right chair. The middle mesh panel connects between a right chair backrest panel and a left chair backrest panel.

The double folding chair also has a right drink pocket formed on a right drink flap of a right arm rest. The right arm rest connects at a right arm rest connects to the right chair. The right drink pocket is made of mesh. A left drink pocket formed on a left drink flap of a left arm rest. The left arm rest is connected at a left arm rest that connects to the left chair. The left drink pocket is made of mesh. The double folding chair also has a right seat panel strap that connects to a left seat panel strap. The right seat panel strap is anchored between a right strap inside anchor and a right strap outside anchor. The right seat panel strap and the left seat panel strap are attached underneath a front edge of the right seat and the left seat. The left seat panel strap is mounted between a left strap inside anchor. The double folding chair also has a right mesh panel that connects the right arm rest to the seat panel and the backrest panel and a left mesh panel that connects the left arm rest to the seat panel and the backrest panel.

The double folding chair also has a footing upper hinge arm formed on the right chair front inside foot and a footing lower hinge arm is formed on the left chair front inside foot. The footing upper hinge arm is bolted to the footing lower hinge arm. A left chair front inside foot inside cross brace flange is formed on the left chair front inside foot. The left chair front inside foot inside cross brace flange is hinged to a left chair inside a cross brace and a right chair front inside foot inside cross brace flange is formed on the right chair front inside foot. The right chair front inside foot inside cross brace flange is hinged to a right chair inside cross brace. The double folding chair also has an upper hinge first hinge arm formed on the right chair front inside joint and an upper hinge second hinge arm formed on the left chair front inside joint. The upper hinge first hinge arm is hinged to the upper hinge second hinge arm. A right chair front inside joint inside cross brace flange is formed on the right chair front inside joint. The right chair front inside joint is hinged to a right chair inside cross brace. A left chair front inside joint inside cross brace flange is formed on the left chair front inside joint. The left chair front inside joint is hinged to a left chair inside cross brace.

Figure 1:
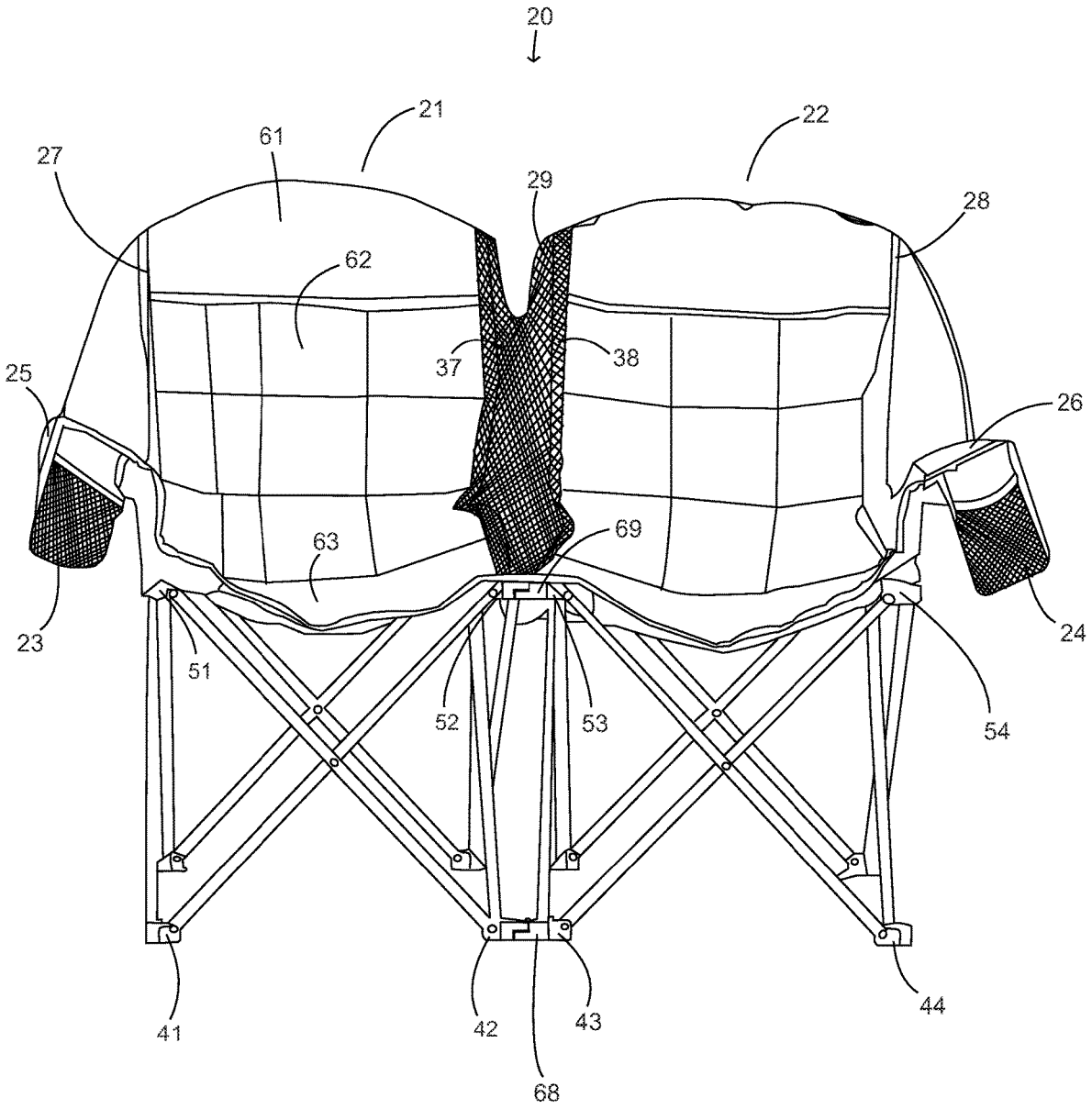
FIG. 1 is a front view of the present invention.

The following call out list of elements can be a useful guide in referencing the element numbers of the drawings.

21 right chair
22 left chair
20 double chair
23 right drink pocket
24 left drink pocket
25 right armrest
26 left armrest
27 right armrest connection
28 left armrest connection
29 middle mesh panel
31 bundle strap
32 shoulder strap
33 left chair outside post
34 left chair inside post
35 right chair inside post
36 right chair outside post
37 mesh middle panel right overlap
38 mesh middle panel left overlap
39 backrest panel sectional stitching
41 right chair front outside foot
42 right chair front inside foot
43 left chair front inside foot
44 left chair from outside foot
51 right chair front outside joint
52 right chair front inside joint
53 left chair front inside joint
54 left chair front outside joint
55 right chair rear outside joint
56 right chair rear inside joint
57 left chair rear inside joint
58 left chair rear outside joint
59 bottle opener
64 right mesh panel
65 left mesh panel
66 right drink flap
67 left drink flap
68 lower hinge
69 upper hinge
71 right seat panel strap
72 left seat panel strap

73 left strap outside anchor
74 right strap outside anchor
75 left strap inside anchor
76 right strap inside anchor
81 Right chair front cross brace
82 left chair front cross brace
83 right chair rear cross brace
84 left chair rear cross brace
85 right chair outside cross brace
86 right chair inside cross brace
87 left chair inside cross brace
88 left chair outside cross brace
91 footing upper hinge arm
92 footing lower hinge arm
93 footing bolt
94 lower hinge nut
95 lower hinge nut recess
96 upper hinge first hinge arm
97 upper hinge second hinge arm
98 upper hinge bolt
99 upper hinge nut
90 upper binge nut recess
101 right chair front inside foot front cross brace flange
102 left chair front inside foot front cross brace flange
103 right chair front inside foot inside cross brace flange
104 left chair front inside foot inside cross brace flange
105 right chair front inside foot front cross brace flange rivet
106 left chair front inside foot front cross brace flange rivet
107 right chair front inside foot inside cross brace flange rivet
108 left chair front inside foot inside cross brace flange rivet
111 right chair front inside joint front cross brace flange
112 left chair front inside joint front cross brace flange
113 right chair front inside joint inside cross brace flange
114 left chair front inside joint inside cross brace flange
115 right chair front inside joint front cross brace flange
116 left chair front inside joint front cross brace flange
117 right chair front inside joint inside cross brace flange
118 left chair front inside joint inside cross brace flange

DETAILED DESCRIPTION OF THE PREFERRED EMBODIMENT

As seen in FIG. 1, the double folding chair 20 has a right chair 21 connected to a left chair 22. Both chairs fold from an expanded position to a collapsed position. The right chair 21 has a right drink pocket 23 attached to a right armrest 25. The left chair 22 has a left armrest 26 with a left drink pocket 24. The left armrest 26 is connected to the left armrest connection 28 on a left side of the left chair 22. Similarly, the right armrest connection 27 connects the right armrest 25 to a right side of the right chair 21. A middle mesh panel 29 connects the left side of the right chair 21 to the right side of the left chair 22. The middle mesh panel 29 is preferably a double layered open mesh allowing airflow through it while capable of retaining articles.

The left chair 22 and the right chair 21 both have a backrest panel 62 and a seat 63 such that there is a left chair backrest panel, a left chair seat, a right chair backrest panel and a right chair seat. The middle mesh panel 29 preferably is attached at a middle mesh panel right overlap 37 and a middle mesh panel left overlap 38. The mesh middle panel left overlap 38 connects to the right side of the left chair and preferably has an overlapping mesh hem. Similarly, the mesh middle panel right overlap 37 also preferably has an overlapping mesh hem.

The left chair and the right chair both have a plurality of swivel joints that can be made of plastic and receiving rivets to tubular steel frame members that are folding and in swivel connection on the rivets. The right chair 21 has a right chair front outside joint 51, and a right chair front inside joint 52. The right chair 21 also has a right chair front outside foot 41 and the right chair front inside foot 42. The right chair front outside foot 41 is mounted below the right chair front outside joint 51. The right chair front inside foot 42 is mounted below the right chair front inside joint 52. The left chair 22 has a left chair front inside joint 53 and a left chair front outside joint 54. It also has a left chair front inside foot 43 and a left chair front outside foot 44. The left chair front inside foot 43 is mounted below the left chair front inside joint 53. The left chair front outside foot 44 is mounted below the left chair front outside joint 54.

An upper hinge 69 is formed between the right chair front inside joint 52 and the left chair front inside joint 53. A lower hinge 68 is formed between the right chair front inside foot 42 and the left chair front inside foot 43. The upper hinge 69 and the lower hinge 68 preferably have the same range of motion to allow the left chair and the right chair to swivel relative to each other, so that the chairs can face each other at an angle in a arc-shaped configuration, and then face the same direction in a parallel configuration.

Figure 2:
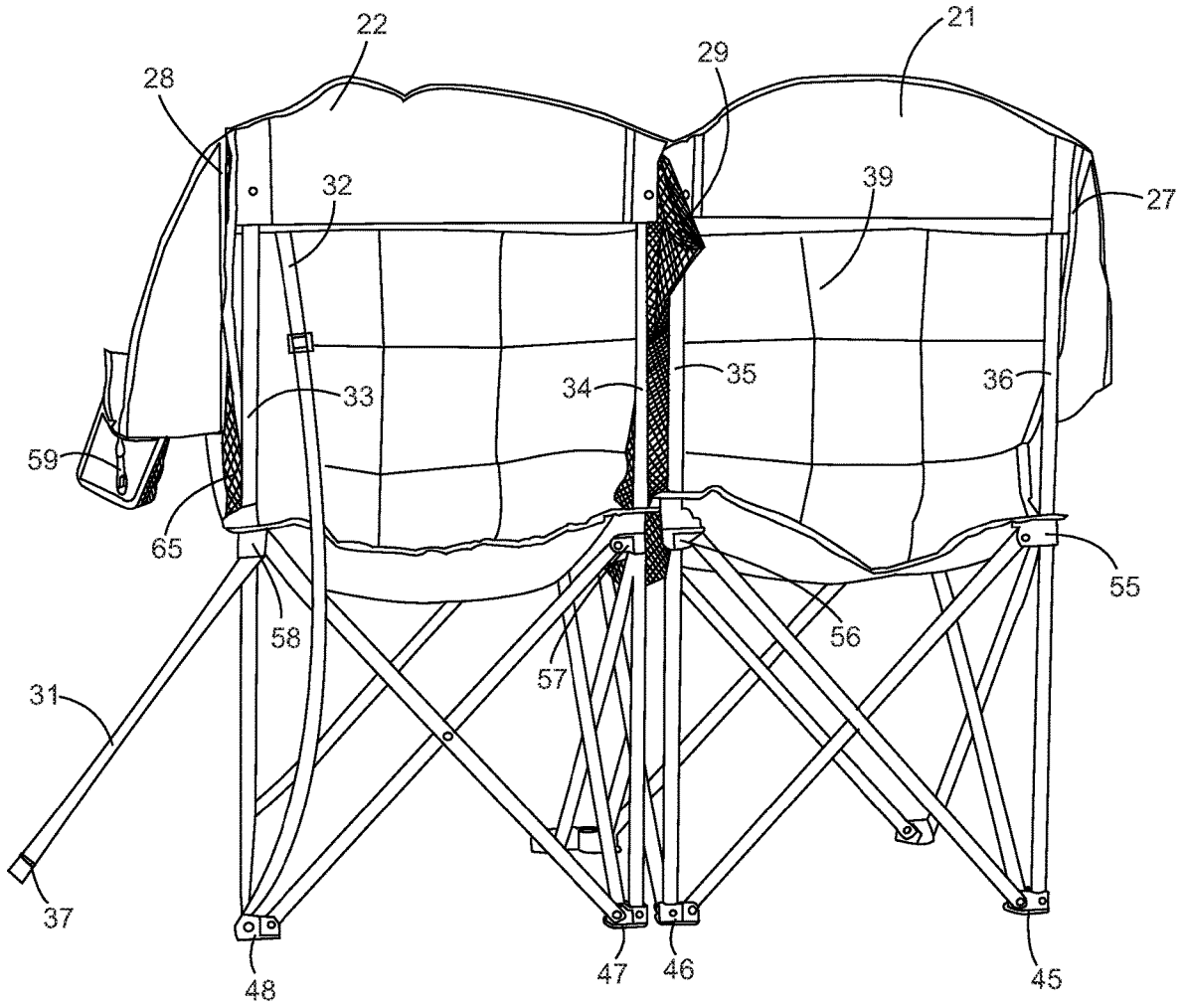
FIG. 2 is a rear view of the present invention.

As seen in FIG. 2, the pair of chairs can be retained in the folded position by a bundle strap 31. The bundle strap 31 connects to the seat 63, or the backrest panel 62 in a manner such as stitching. The bundle strap 31 wraps around the pair of chairs in folded position and locks with a bundle strap buckle 37. Additionally, the pair of chairs can be carried by a shoulder strap. The shoulder strap can be stitched to the backrest panel 62. The backrest panel 62 may additionally include backrest panel sectional stitching 39 with padding held between a pair of layers, namely a rear layer and a front layer. The left chair has a left chair outside post 33 and a left chair inside post 34. The left chair outside post 33 extends downwardly to engage to a left chair rear outside foot 48. The left chair inside post 34 extends downwardly to engage to a left chair rear inside foot 47. The left chair outside post 33 passes through a left chair rear outside joint 58, and the left chair inside post 34 passes through a left chair rear inside joint 57. Therefore, the left chair rear outside joint 58 and the left chair rear inside joint 57 both slide along their respective posts while being supported by their respective foot.

The right chair has a right chair inside post 35 and a right chair outside post 36. The right chair inside post 35 extends through the right chair rear inside joint 56 downwardly to abut the right chair rear inside foot 46. Similarly, the right chair outside post 36 extends through the right chair rear outside joint 55 downwardly to the right chair rear outside foot 45. Additionally, a bottle opener 59 can be added to each of the armrests. The left chair rear outside foot 48 is mounted below the left chair rear outside joint 58. The left chair rear inside foot is mounted below the left chair rear inside joint 57. The right chair rear inside foot 46 is mounted below the right chair rear inside joint 56. The right chair rear outside foot 45 is mounted below the right chair rear outside joint 55.

Figure 3:
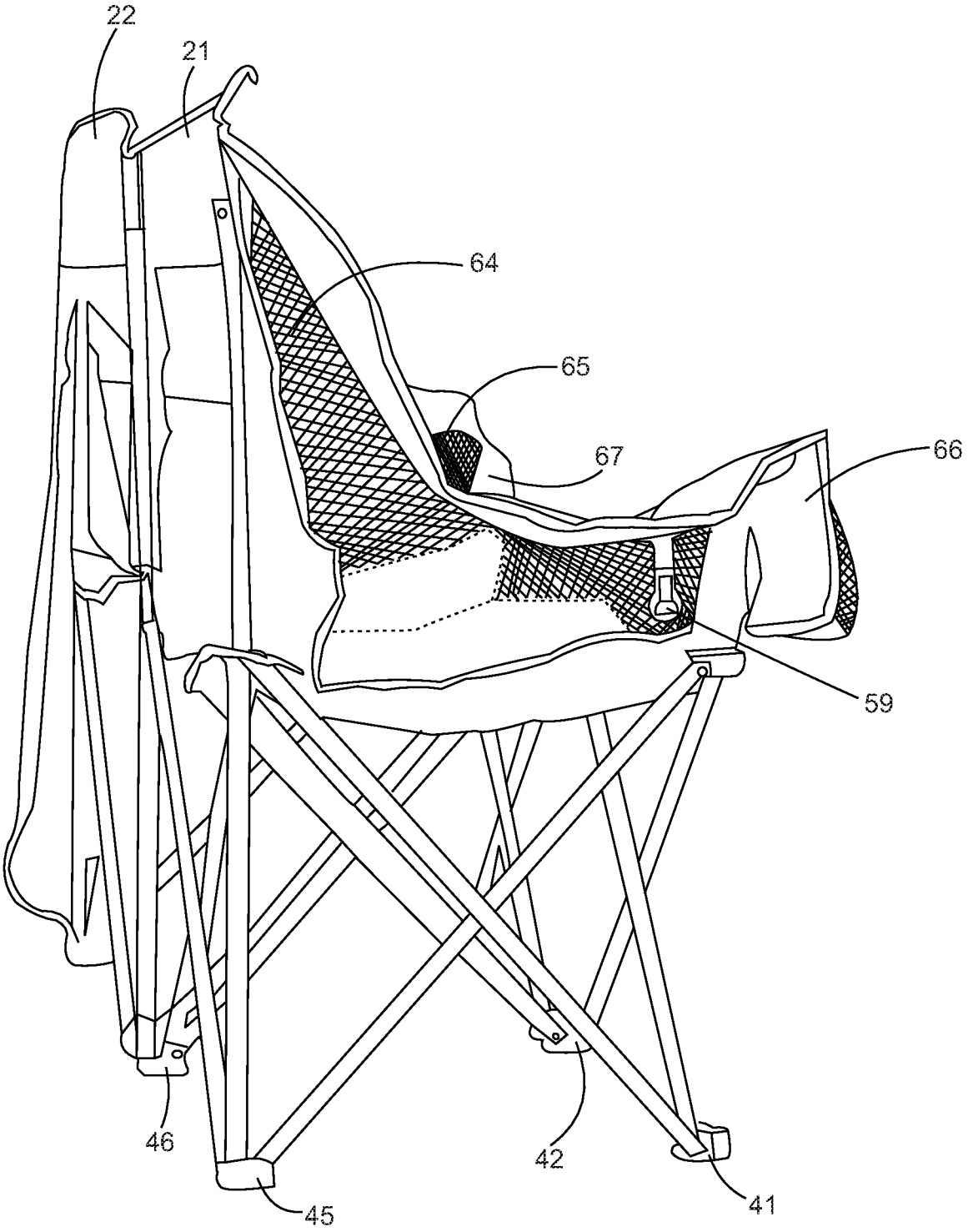
FIG. 3 is a right side view of the present invention.
Figure 4:
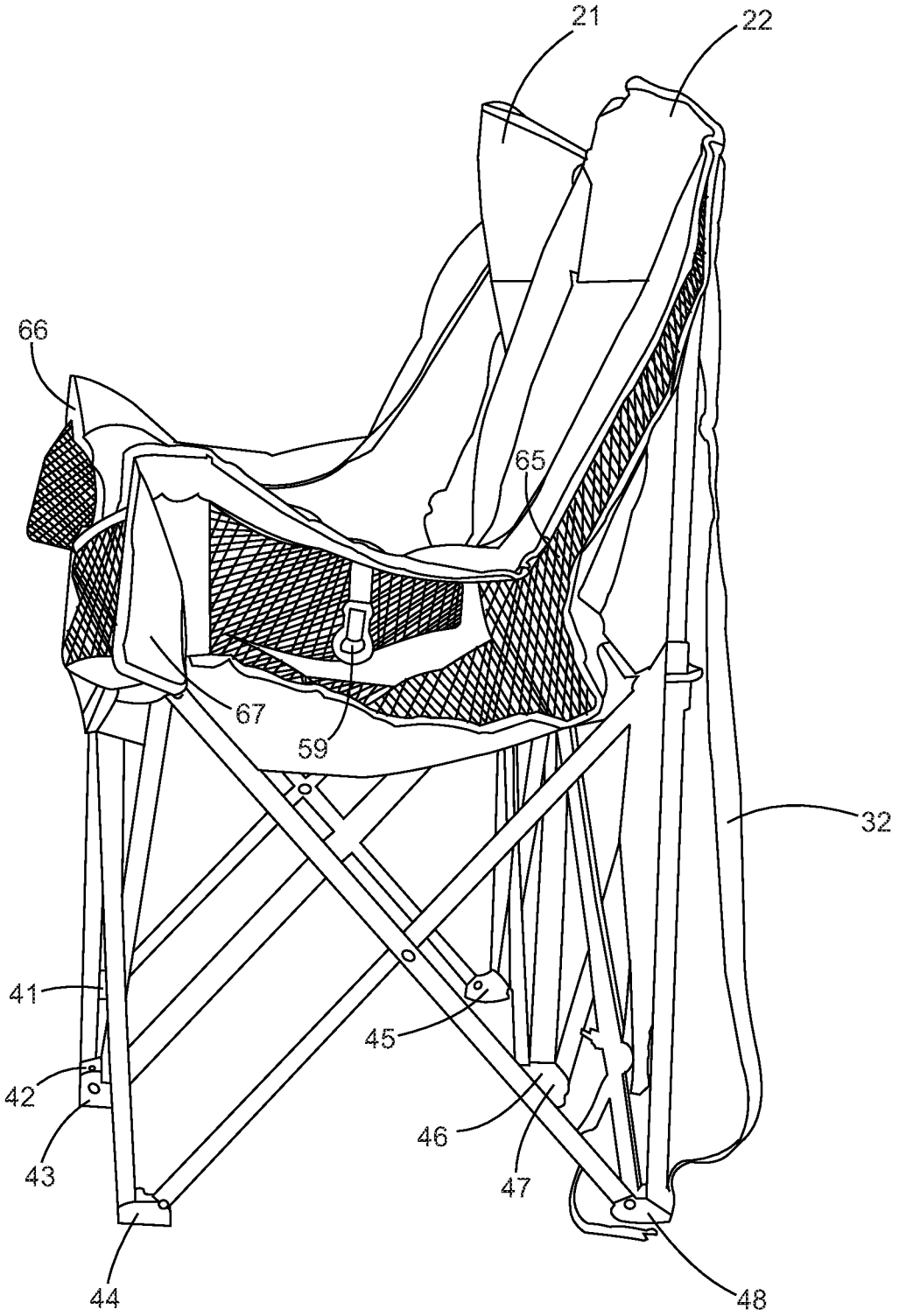
FIG. 4 is a left side view of the present invention.
Figure 7:
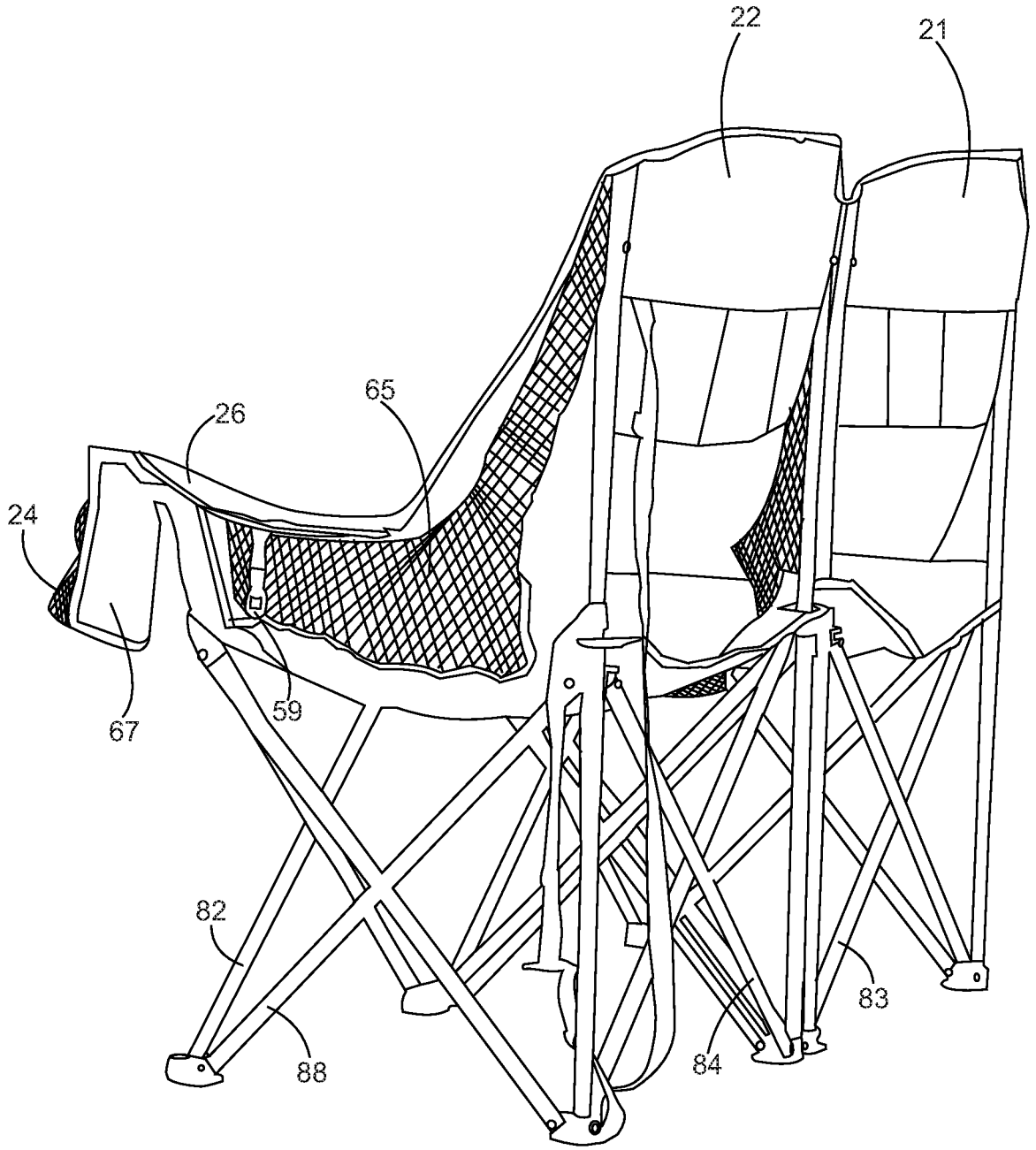
FIG. 7 is a rear left view of the present invention.

As seen in FIGS. 3, 4, 7, the right chair has a right mesh panel 64 below the right arm rest. The right arm rest extends to a right drink flap 66. The left chair has a left mesh panel 65 below the left arm rest. The left arm rest extends to a left drink flap 67. The drink pockets are mounted to the drink flaps. The drink flaps are solid fabric sheets, but the drink pockets have open mesh.

Figure 5:
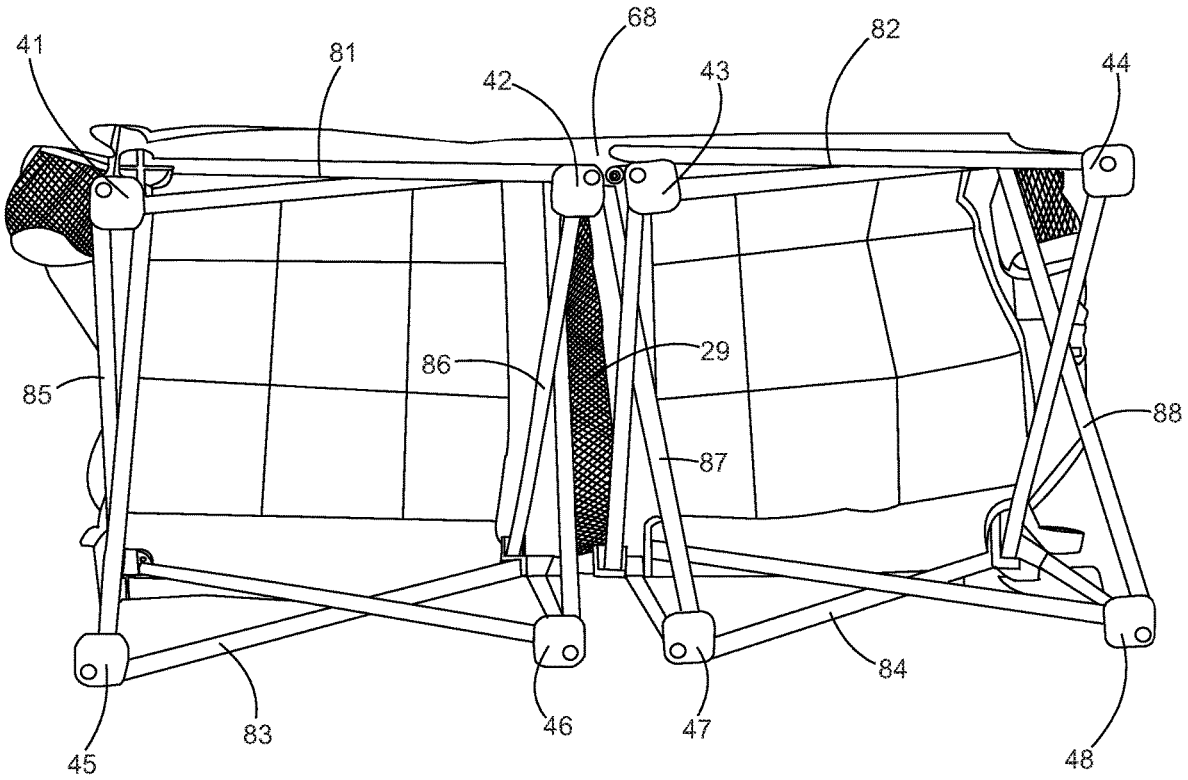
FIG. 5 is a bottom view of the present invention.

As seen in FIG. 5, a right chair front cross brace 81 extends across and between the right chair front outside foot 41 and the right chair front inside foot 42. The left chair front cross brace 82 extends across and between the left chair front outside foot 44 and the left chair front inside foot 43. The left chair rear cross brace 84 connects between the left chair rear inside foot 47 and the left chair rear outside foot 48. Similarly, the right chair rear cross brace 83 connects between the right chair rear inside foot 46 and the right chair rear outside foot 45.

The left chair inside cross brace 87 connects between the left chair front inside foot 43 and the left chair rear inside foot 47. The right chair inside cross brace 86 connects between the right chair front inside foot 42 and the right chair rear inside foot 46. The right chair outside cross brace 85 connects between the right chair rear outside foot 45 and the right chair front outside foot 41. The left chair outside cross brace 55 connects between the left chair front outside foot 44 and the left chair rear outside foot 48.

Figure 6:
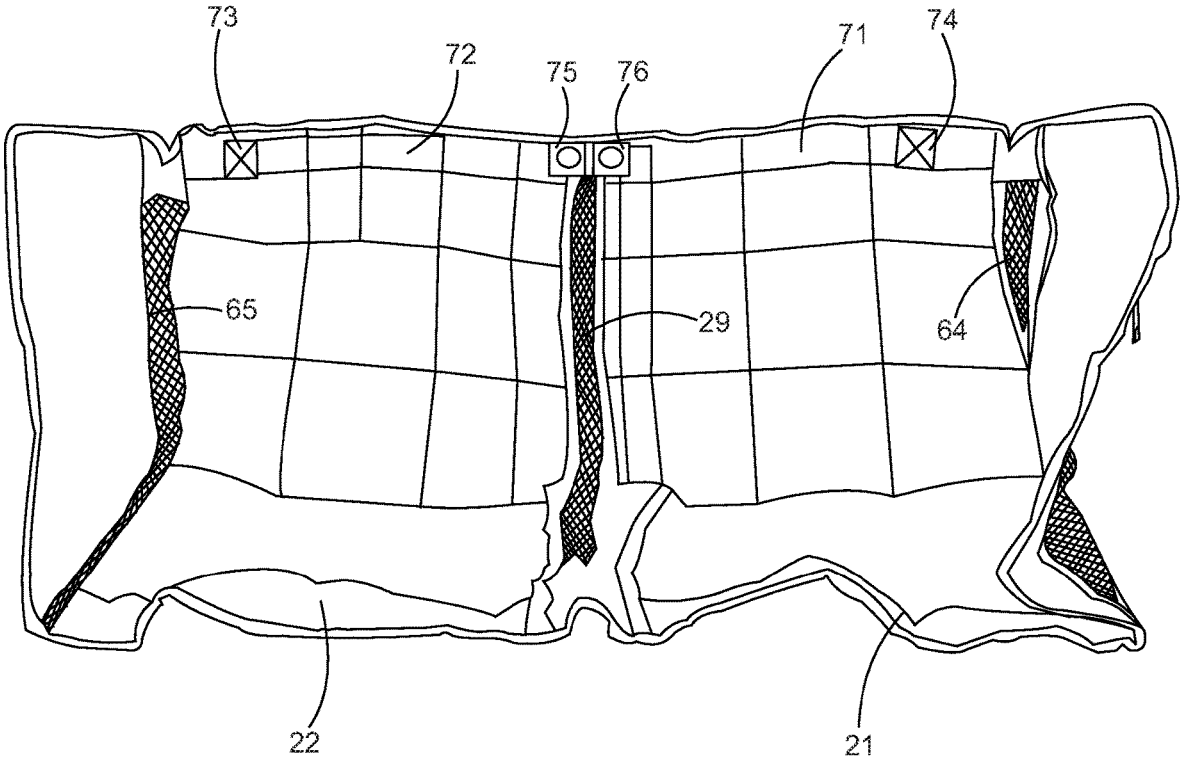
FIG. 6 is a top view of the present invention.

As seen in FIG. 6, the top view of the invention shows a reinforcement strap structure. A right seat panel strap 71 connects to a left seat panel strap 72. The right seat panel strap 71 is anchored between a right strap inside anchor 76 and a right strap outside anchor 74. The right strap outside anchor 74 is formed underneath a front edge of the seat 63. The right seat panel strap 71 is also formed on a front edge of the seat 63. The right strap outside anchor 74 anchors a loop that ties around or loops around the right chair front outside joint 51. The left seat panel strap 72 is mounted between a left strap inside anchor 75 and a left strap outside anchor 73. The left strap outside anchor 73 anchors a left loop of the left seat panel strap 72 underneath the front edge of the seat 63. The left loop loops around the left chair front outside joint 54. The reinforcement strap structure thus reinforces the strength between the supports of the seat 63.

Figure 8:
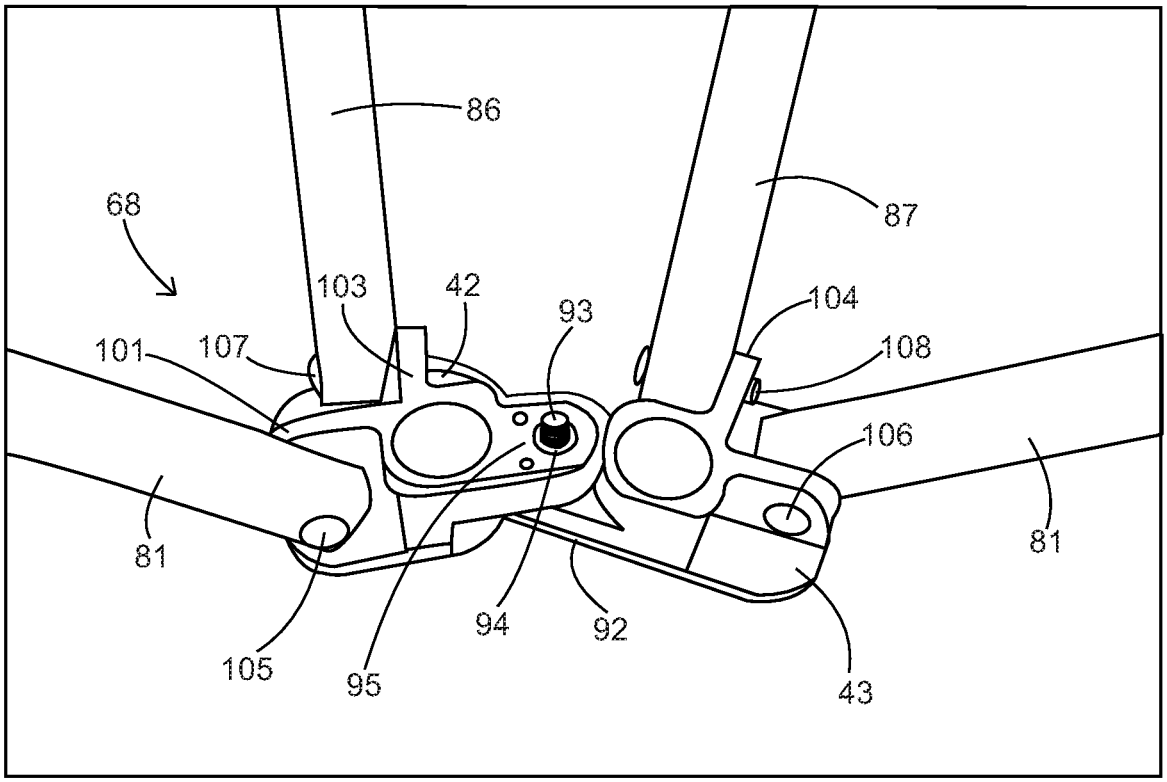
FIG. 8 is a close-up detail view of the lower hinge.

As seen in FIG. 8, the lower hinge 68 has a number of details including five pivoting joint connections that could be implemented by bolts or rivets or the like. Footing lower hinge arm 92 and the footing upper hinge arm 91 are connected at a footing bolt 93 which forms an axis of rotation. The footing bolt 93 has a lower hinge nut 94 held within a lower hinge nut recess 95 which retains the lower hinge nut 94. The footing upper hinge arm 91 extends to a right chair front inside foot cross brace flange 103 which receives a right chair front inside foot inside cross brace flange rivet 107 that provides a pivoting connection to the right chair inside cross brace 86. Similarly, the right chair front inside foot front cross brace flange 101 receives a pivoting connection to the right chair front cross brace 81 at a right chair front inside foot front cross brace flange rivet 105. The left chair front inside foot inside cross brace flange 104 extends from the footing lower hinge arm 92 and is pivotally connected at the left chair front inside foot inside cross brace flange rivet 108 to the left chair inside cross brace 87. The left chair front inside foot front cross brace flange 102 is pivotally connected by the left chair front inside foot front cross brace flange rivet 106 to the left chair front cross brace 82.

Figure 9:
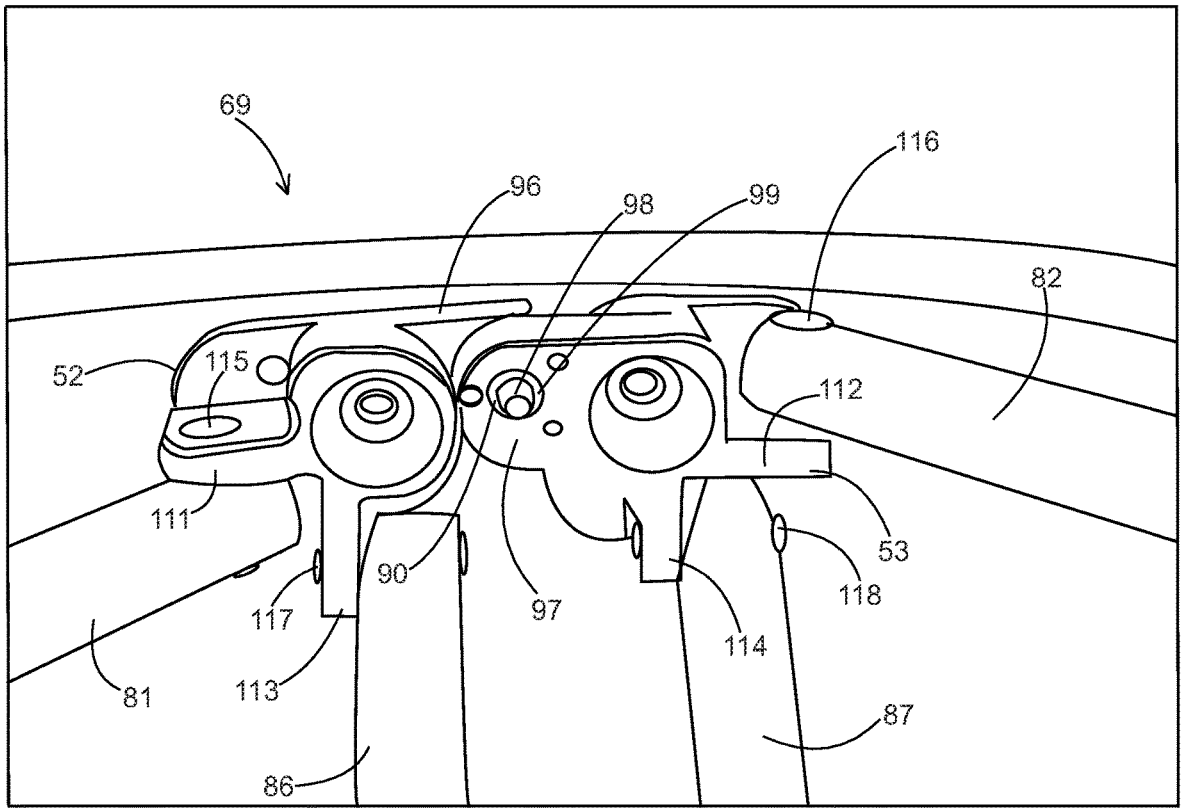
FIG. 9 a close-up detail view of the upper hinge.

As seen in FIG. 9, the upper hinge 69 has an upper hinge first hinge arm 96 mounted above an upper hinge second binge arm 97. The upper hinge 69 has an upper hinge nut recess 90 that receives an upper hinge nut 99. The upper hinge nut 99 engages an upper hinge bolt 98 to form the pivoting axis for the upper hinge 69. The upper hinge second hinge arm 97 is preferably mounted below the upper hinge first hinge arm 96 such that the upper hinge first hinge arm 96 has a bottom surface that is flat that abuts a flat surface of the upper surface of the upper hinge second hinge arm 97.

The right chair front inside joint front cross brace flange 111 is pivotally connected by a right chair front inside joint front cross brace flange rivet 115 to a right chair front cross brace 81. The left chair front inside joint front cross brace flange 112 is pivotally connected by a left chair front inside joint front cross brace flange rivet 116 to a left chair front cross brace 82. The right chair front inside joint inside cross brace flange 113 is pivotally connected by a right chair front inside joint inside cross brace flange rivet 117. The left chair front inside joint inside cross brace flange 114 is pivotally connected by a left chair front inside joint inside cross brace flange rivet 118 to the left chair inside cross brace 87.

The invention claimed is:

1. A double folding chair comprising:

a. a left chair having a left chair front inside foot and a left chair front inside joint, wherein a left chair front cross brace supports the a left chair front inside joint above the left chair front inside foot, wherein the left chair front cross brace unfolds to an expanded configuration;

b. a right chair having a right chair front inside foot and a right chair front inside joint, wherein a right chair front cross brace supports the right chair front inside joint above the right chair front inside foot, wherein the right chair front cross brace unfolds to an expanded configuration;

c. an upper hinge connecting the right chair front inside joint to the left chair front inside joint; a lower hinge connecting the right chair front inside foot to the left chair front inside foot; and d. a middle mesh panel connecting the left chair to the right chair, wherein the middle mesh panel connects a left side of the right chair to a right side of the left chair, wherein the middle mesh panel connects between a right chair backrest panel and a left chair backrest panel, further comprising a mesh middle panel right overlap providing a right vertical connection to the right chair backrest panel and a mesh middle panel left overlap providing a left vertical connection to the left chair backrest panel, wherein the middle mesh panel connects horizontally between the left seat and the right seat.

2. The double folding chair of claim 1, further comprising:

a. a right drink pocket formed on a right drink flap of a right arm rest, wherein the right arm rest is connected at a right arm rest connection to the right chair, wherein the right drink pocket is made of mesh; and b. a left drink pocket formed on a left drink flap of a left arm rest, wherein the left arm rest is connected at a left arm rest connection to the left chair, wherein the left drink pocket is made of mesh.

3. The double folding chair of claim 1, further comprising: a right seat panel strap connecting to a left seat panel strap, wherein the right seat panel strap is anchored between a right strap inside anchor and a right strap outside anchor, wherein the right seat panel strap and the left seat panel strap are attached underneath a front edge of the right seat and the left seat, wherein the left seat panel strap is mounted between a left strap inside anchor and a left strap outside anchor.

4. The double folding chair of claim 1, further comprising: a right mesh panel connecting the right arm rest to the seat panel and the backrest panel, and a left mesh panel connecting the left arm rest to the seat panel and the backrest panel.

5. The double folding chair of claim 1, further comprising: a footing upper hinge arm formed on the right chair front inside foot, and a footing lower hinge arm formed on the left chair front inside foot, wherein the footing upper hinge arm is bolted to the footing lower hinge arm.

6. The double folding chair of claim 5, further comprising: a left chair front inside foot inside cross brace flange formed on the left chair front inside foot, wherein the left chair front inside foot inside cross brace flange is hinged to a left chair inside cross brace; and a right chair front inside foot inside cross brace flange formed on the right chair front inside foot, wherein the right chair front inside foot inside cross brace flange is hinged to a right chair inside cross brace.

7. The double folding chair of claim 1, further comprising: an upper hinge first hinge arm formed on the right chair front inside joint, and an upper hinge second hinge arm formed on the left chair front inside joint, wherein the upper hinge first hinge arm is hinged to the upper hinge second hinge arm.

8. The double folding chair of claim 7, further comprising: a right chair front inside joint inside cross brace flange formed on the right chair front inside joint, wherein the right chair front inside joint is hinged to a right chair inside cross brace; a left chair front inside joint inside cross brace flange formed on the left chair front inside joint, wherein the left chair front inside joint is hinged to a left chair inside cross brace.

9. A double folding chair comprising:

a. a left chair having a left chair front inside foot and a left chair front inside joint, wherein a left chair front cross brace supports the a left chair front inside joint above the left chair front inside foot, wherein the left chair front cross brace unfolds to an expanded configuration;

b. a right chair having a right chair front inside foot and a right chair front inside joint, wherein a right chair front cross brace supports the right chair front inside joint above the right chair front inside foot, wherein the right chair front cross brace unfolds to an expanded configuration;

c. an upper hinge connecting the right chair front inside joint to the left chair front inside joint; a lower hinge connecting the right chair front inside foot to the left chair front inside foot;

d. a middle mesh panel connecting the left chair to the right chair, wherein the middle mesh panel connects between a right chair backrest panel and a left chair backrest panel;

e. a right drink pocket formed on a right drink flap of a right arm rest, wherein the right arm rest is connected at a right arm rest connection to the right chair, wherein the right drink pocket is made of mesh;

f. a left drink pocket formed on a left drink flap of a left arm rest, wherein the left arm rest is connected at a left arm rest connection to the left chair, wherein the left drink pocket is made of mesh; and g. a right seat panel strap connecting to a left seat panel strap, wherein the right seat panel strap is anchored between a right strap inside anchor and a right strap outside anchor, wherein the right seat panel strap and the left seat panel strap are attached underneath a front edge of the right seat and the left seat, wherein the left seat panel strap is mounted between a left strap inside anchor and a left strap outside anchor, wherein the middle mesh panel connects a left side of the right chair to a right side of the left chair, further comprising a mesh middle panel right overlap providing a right vertical connection to the right chair backrest panel and a mesh middle panel left overlap providing a left vertical connection to the left chair backrest panel, wherein the middle mesh panel connects horizontally between the left seat and the right seat.

10. The double folding chair of claim 9, further comprising: a right mesh panel connecting the right arm rest to the seat panel and the backrest panel, and a left mesh panel connecting the left arm rest to the seat panel and the backrest panel.

11. The double folding chair of claim 9, further comprising: a footing upper hinge arm formed on the right chair front inside foot, and a footing lower hinge arm formed on the left chair front inside foot, wherein the footing upper hinge arm is bolted to the footing lower hinge arm.

12. The double folding chair of claim 11, further comprising: a left chair front inside foot inside cross brace flange formed on the left chair front inside foot, wherein the left chair front inside foot inside cross brace flange is hinged to a left chair inside cross brace; and a right chair front inside foot inside cross brace flange formed on the right chair front inside foot, wherein the right chair front inside foot inside cross brace flange is hinged to a right chair inside cross brace.

13. The double folding chair of claim 9, further comprising: an upper hinge first hinge arm formed on the right chair front inside joint, and an upper hinge second hinge arm formed on the left chair front inside joint, wherein the upper hinge first hinge arm is hinged to the upper hinge second hinge arm.

14. The double folding chair of claim 13, further comprising: a right chair front inside joint inside cross brace flange formed on the right chair front inside joint, wherein the right chair front inside joint is hinged to a right chair inside cross brace; a left chair front inside joint inside cross brace flange formed on the left chair front inside joint, wherein the left chair front inside joint is hinged to a left chair inside cross brace.

* * * * *